US005153402A

United States Patent [19]

Quick et al.

[11] Patent Number: 5,153,402

[45] Date of Patent: Oct. 6, 1992

[54] PAPERBOARD CONTAINER FOR MICROWAVE COOKING

[75] Inventors: James R. Quick, Greenwood Lake, N.Y.; James W. Mitchell, Sewell, N.J.

[73] Assignee: International Paper Company, Purchase, N.Y.

[21] Appl. No.: 618,360

[22] Filed: Nov. 21, 1990

[51] Int. Cl.[5] ..... H05B 6/80; B65D 5/00

[52] U.S. Cl. ..... 219/10.55 E; 426/107; 426/110; 426/113; 99/DIG. 14; 229/87.09; 229/117.01; 229/903

[58] Field of Search ..... 219/10.55 E, 10.55 F; 426/107, 234, 243, 110; 206/476, 477; 229/104, 23 R, 107, 23 A, 108.1, 117.01, 117.05, 117.07, 125.03, 126, 131.1, 155, 903, 87.09; 99/DIG. 14

[56] References Cited

U.S. PATENT DOCUMENTS

| | | | |
|---|---|---|---|
| 196,358 | 10/1887 | Heath | 229/114 |
| 711,813 | 10/1902 | Austin | 229/104 |
| 978,569 | 12/1910 | Elkin | 229/104 |
| 1,513,608 | 10/1924 | Labombarde | 229/104 |
| 1,908,841 | 5/1933 | Hawks | 229/104 |
| 2,054,302 | 9/1936 | Scotes | 229/104 |
| 2,437,835 | 3/1948 | Riege et al. | 229/117.07 |
| 2,600,566 | 6/1952 | Moffett, Jr. | 219/10.55 E |
| 2,796,211 | 6/1957 | Wagner | 206/496 |
| 2,829,816 | 4/1958 | Jason | 229/23 R |
| 3,938,729 | 2/1976 | Smith | 229/176 |
| 3,993,239 | 11/1976 | Exel | 229/23 R |
| 4,086,071 | 4/1978 | Champlin | 229/168 |
| 4,143,647 | 3/1979 | Husslein et al. | 219/10.55 E |
| 4,177,917 | 12/1979 | Webinger | 229/172 |
| 4,372,477 | 2/1983 | Wytko | 229/23 A |
| 4,432,489 | 2/1984 | Cote | 229/903 |
| 4,553,671 | 11/1985 | Cheesman | 229/23 R |
| 4,571,340 | 2/1986 | Ferrante | 426/113 |
| 4,592,914 | 6/1986 | Kuchenbecker | 219/10.55 E |
| 4,594,492 | 6/1986 | Maroszek | 99/DIG. 14 |
| 4,836,383 | 6/1989 | Gordon et al. | 219/10.55 E |
| 4,866,232 | 9/1989 | Stone | 219/10.55 E |
| 4,877,932 | 10/1989 | Bernstein et al. | 219/10.55 E |

*Primary Examiner*—Bruce A. Reynolds
*Assistant Examiner*—Tuan Vinh To
*Attorney, Agent, or Firm*—Michael J. Doyle; Walt Thomas Zielinski

[57] ABSTRACT

A microwave cooking tray for microwave ovenable foodstuffs which usually display browned or crisped areas upon conventional oven cooking. The container is formed from a one piece blank of dielectric material, such as paperboard, which is bent and folded to form a trough shaped tray. A microwave interactive component included in the blank provides thermal heating effects such as browning and crisping for foodstuff placed in the tray and heated in a microwave oven. The tray is foldable to a flat configuration to facilitate shipment and storage. In one embodiment, the tray is flat on its entire upper portion when cooking.

28 Claims, 9 Drawing Sheets

FIG. 2
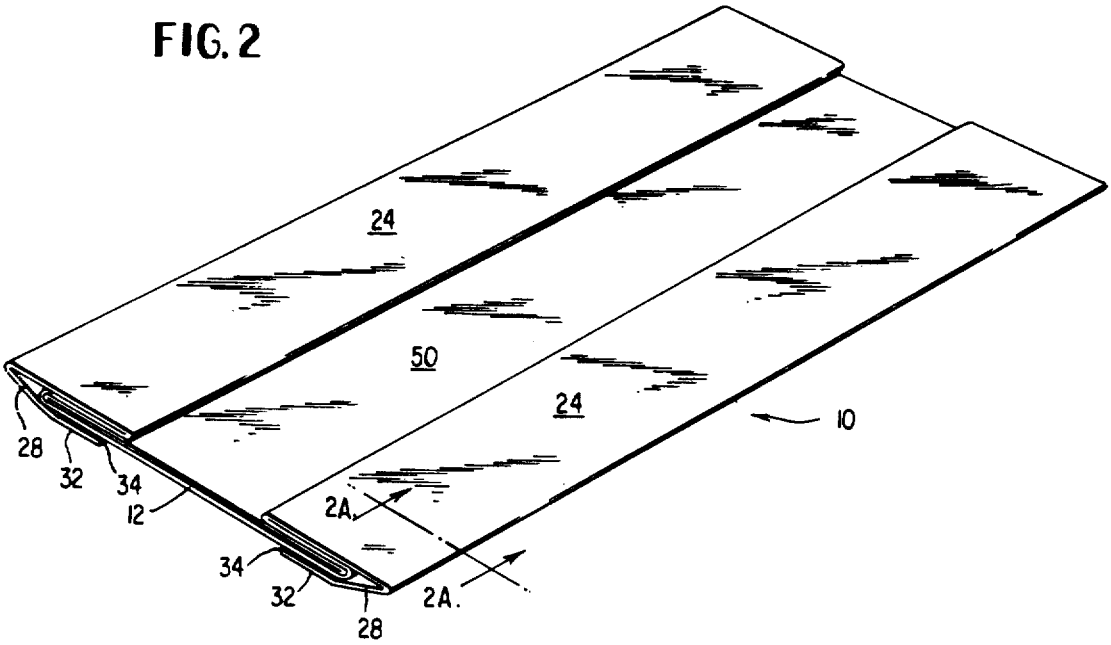
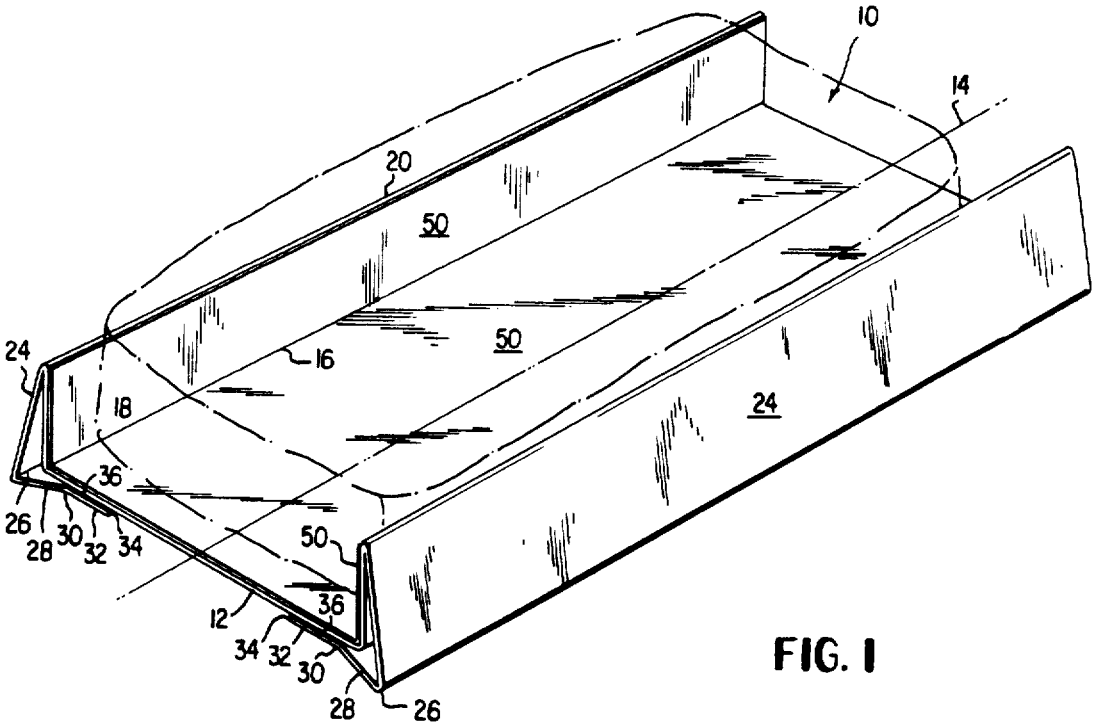
FIG. 1

PAPERBOARD CONTAINER FOR MICROWAVE COOKING

BACKGROUND OF THE INVENTION

This invention relates to microwave cooking and particularly to a container for microwave cooked foodstuffs which are to be provided with browned or crispened areas over at least a portion of their surfaces.

In the cooking of certain types of foodstuffs, such as potatoes, microwave ovens display a variety of advantages, the most common of which is rapidity of cooking. However, in certain other types of food products, such as French bread pizza, microwave cooking will usually not produce the desired browning. In order to provide such browning, a variety of package and container configurations have evolved in this art, such containers usually being provided with a microwave interactive substance or coating having the property of converting microwave energy to thermal energy. A microwave interactive material or substance is usually in the form of a coating that comprises part of the composition of the material from which the container is formed and has the property of increasing its own temperature by at least a partial absorption of the energy of the microwaves, and then transmitting thermal energy to a foodstuff. The usual frequency of such microwaves is about 2450 megahertz. A variety of microwave interactive materials has evolved, examples being shown in U.S. Pat. Nos. 2 830,162, issued to Copsol et al, 4,190,757 issued to Turpin et al, 4,283,427 issued to Winters et al 4,266,106 issued to Anderson et al. A widely used microwave interactive material is defined by a thin layer of aluminum, coated on a plastic film by vapor deposition techniques with the aluminum-coated film adhered to a paperboard substrate, and is shown in Seiferth U.S. Pat. No. 4,641,005.

While a variety of container configurations provided with a microwave interactive coating or substance are known, most of the containers suffer the drawback of not conforming to the food product which they package, this often being due to the irregular shape or size of the food product. This is particularly true when the food product is a solid item such as a French bread pizza that may vary in size and consequently may not conform exactly to a specified shape. This, in turn, will limit the effectiveness of the microwave interactive material in its browning function, because the interactive material will in such cases not be in direct contact with the food, even though the containers are of fairly uniform dimensions.

SUMMARY OF THE INVENTION

According to the practice of this invention, a packaging means, in the form of a collapsible container or tray preferably formed of paperboard in combination with a microwave interactive material, is provided which will at least partially adjust to various food sizes, such as French bread pizza, so as to maintain surface contact between the food and the panels of the container that carry the microwave interactive material, to thereby insure browning/crisping. Additionally, the container of this invention raises the food product above the bottom shelf or turntable of the microwave oven. The packaging container of this invention is foldable to flattened form after its manufacture. The container may be opened by the food packager for placement of a foodstuff therein; or the container may be supplied to the consumer in flattened form for opening and placement of the foodstuff therein just before microwave cooking. In either case, the container has the distinctive feature that it is held in the opened and erected form by the force of the food against at least two panels of the container.

BRIEF DESCRIPTION OF THE DRAWINGS

FIG. 1 is a perspective view of the container or tray of this invention.

FIG. 2 is a view of the container of FIG. 1 shown in its collapsed or flat condition.

DETAILED DESCRIPTION OF THE INVENTION

Figure 3:
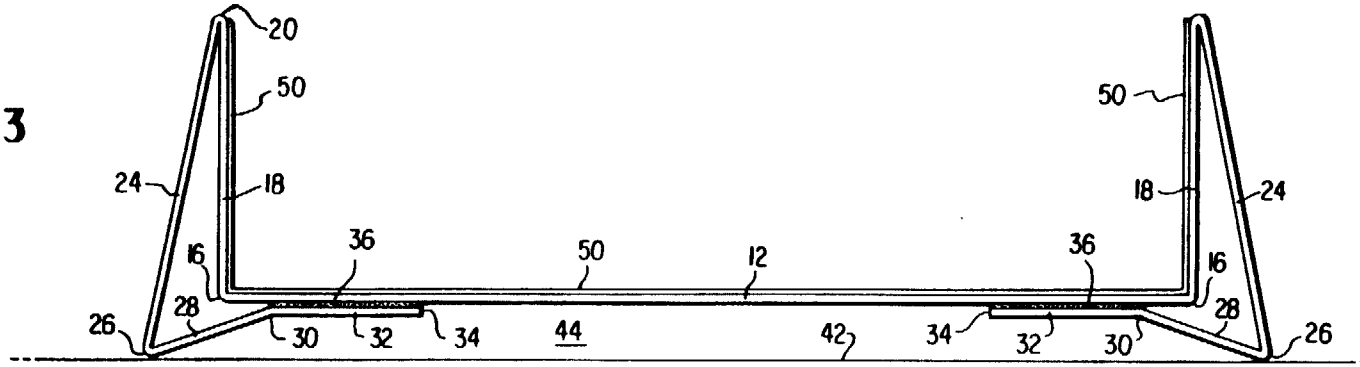
FIG. 3 is an end view of the tray of FIG. 1.

Referring now to FIGS. 1 and 3 of the drawings the numeral 10 denotes generally the container or tray of this invention and is defined by a sheet of stiff, resilient and foldable dielectric material, such as paperboard, which is creased, folded and glued so as to assume the form shown at FIG. 1. The numeral 12 denotes a central, food supporting bottom panel portion having a longitudinal axis 14 of mirror symmetry. The numeral 16 denotes a crease along one of the two opposite longitudinal edges of bottom 12, with numeral 18 denoting an upstanding wall terminating in a substantially 180 degree crease or bend denoted by the numeral 20. The numeral 24 denotes a second generally vertically extending wall or panel portion of greater width, or as shown in FIG. 1, greater vertical dimension than that of wall 18. The lower end of wall 24 terminates in a crease 26 from which continues, toward axis 14, an upwardly slanting panel portion 28. Slanting portion 28 meets crease 30, from which a horizontally disposed panel portion 32 of the sheet extends, terminating at free edge 34. Crease 30 is located radially inward of crease 16 (as referred to axis 14).

The right and left hand portions of the tray are both of the construction just described, the tray thus exhibiting mirror symmetry about longitudinal axis 14.

The container shown at FIG. 1 is thus in the general form of a trough having side walls of double thickness, being spaced apart, one thickness defined by radially innermost wall 18, and the second thickness defined by radially outermost wall of panel 24 (as referred to axis 14). The lower portion of wall 24 and upwardly slanting panel 28 are both beneath the plane of central panel 12 and define an elongated leg, the trough then having two such elongated legs at either longitudinal side of central panel 12.

An adhesive, denoted by the numeral 36, serves to fasten panel 32 to the lower or bottom surface of central portion 12. As will later be explained, the radially inward extent of free edges 34, toward longitudinal axis 14, may be varied.

The numeral 50 denotes a layer of material comprised at least partially of a microwave interactive component having the property of converting microwave energy to thermal energy. Such a material is sometimes referred to as a susceptor material. This layer of material covers the upper surface of bottom panel 12 and the facing, inner surfaces of wall panels 18. For ease of discussion the layer of material 50 that includes a microwave interactive component will hereinafter be referred to as the thermal heating layer.

Figure 2A:
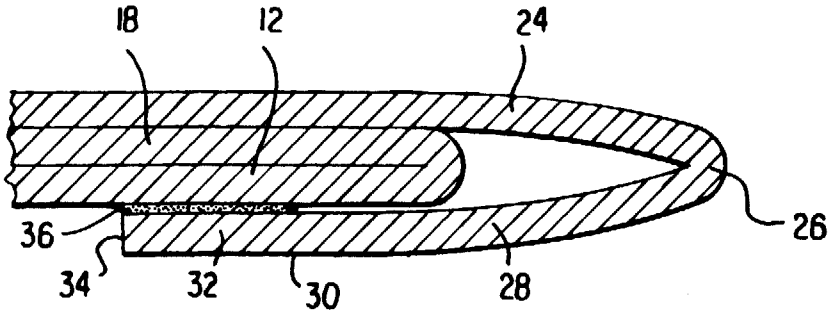
FIG. 2A is a view taken along section 2A—2A of FIG. 2.

FIG. 2 illustrates the container of FIG. 1 in its collapsed condition. Namely, it may be collapsed to a substantially flattened configuration for purposes of storage and/or shipment. It will be noted that the inherent flexibility of the paperboard is important in achieving the flattened configurations of the containers of this invention. Panels 24 and 28 must deform slightly to achieve the folded configuration shown at FIG. 2. The deformation of panels 24 and 28 will generally not be apparent to the observer of the flattened container, and the deformation of these panels is also not apparent is FIG. 2. However, the folded configuration cannot be achieved without some flexing of the paperboard in these panels. This is also true of the other embodiments of the present invention that will be discussed subsequently. FIG. 2*b* is an enlarged view of a section of the folded tray, showing in somewhat exaggerated fashion the required flexing of panels 24 and 28.

A foodstuff is represented by the broken line form in FIG. 1. It is a key feature of this invention that the foodstuff forces the sidewalls 18 of the container outward and this holds the container in the erected configuration. Thus the placement of the foodstuff in the container brings about the erection of the container, and the foodstuff is thereby elevated on the central food supporting panel 12. It is another feature of this invention that the weight of the foodstuff on panel 12 generates rotational forces in specific elements of the container in such a manner that the sidewalls 18 are forced against the sides of the foodstuff. The manner in which the container uses the weight of the food to perform the latter function will be discussed in greater detail subsequently. The capability of the container of this invention to maintain contact between the sidewalls 18 and the foodstuff is particularly important in those embodiments where the sidewalls are covered with the thermal heating layer, such as the container in FIGS. 1-3.

It will be appreciated now that the container of this invention exhibits a unique combination of features, being collapsible to a flattened form, self-erecting upon placement of a foodstuff therein, and self-adjusting to accommodate variations in the size of the foodstuff; in addition to providing the means of browning and crisping the foodstuff in a microwave oven and elevating the foodstuff above the bottom shelf or turntable of the oven. Prior art containers do not offer this combination of features and functions.

This invention allows substantial freedom in the extent and manner of distribution of the thermal heating layer over the various panel portions of the container. Reference now to FIGS. 4-8 illustrates typical variations in patterns, apart from the pattern shown in FIGS. 1-3, of the distribution of the thermal heating layer over the panels of the container of this invention, it being understood that in all patterns, the coating extends from one longitudinal end of the tray to the other end.

Figure 4:
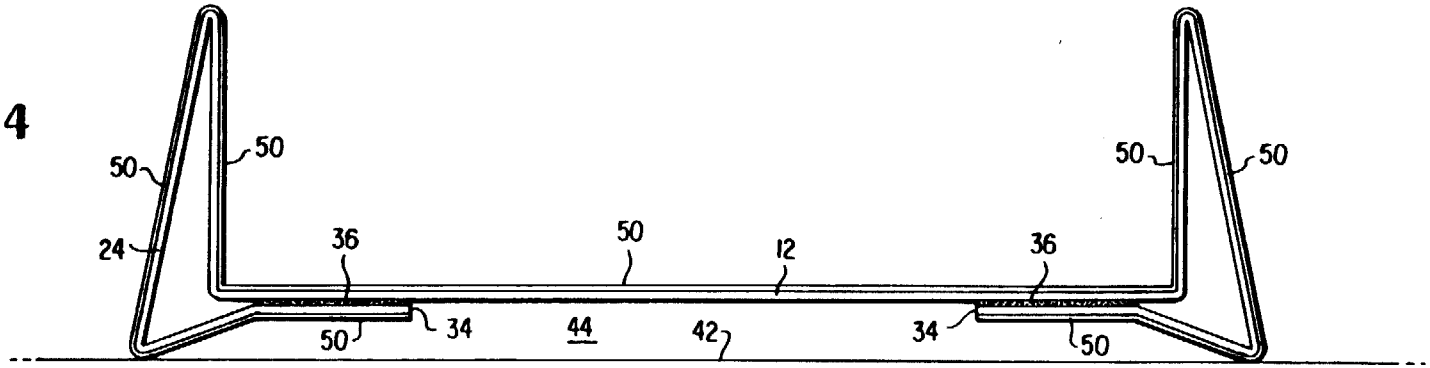
FIGS. 4 to 8 are end views similar to that of FIG. 3 and illustrate other patterns of the microwave interactive material.

In FIG. 4, the area covered by the thermal heating layer 50 extends from the bottom 12, which it covers, up the interior surface of each wall panel 18 to upper edge 20 and continues downwardly and is coextensive with panel portions 24, 28 and 32, the thermal heating layer terminating at the free edge 34 of panel 32.

Figure 5:
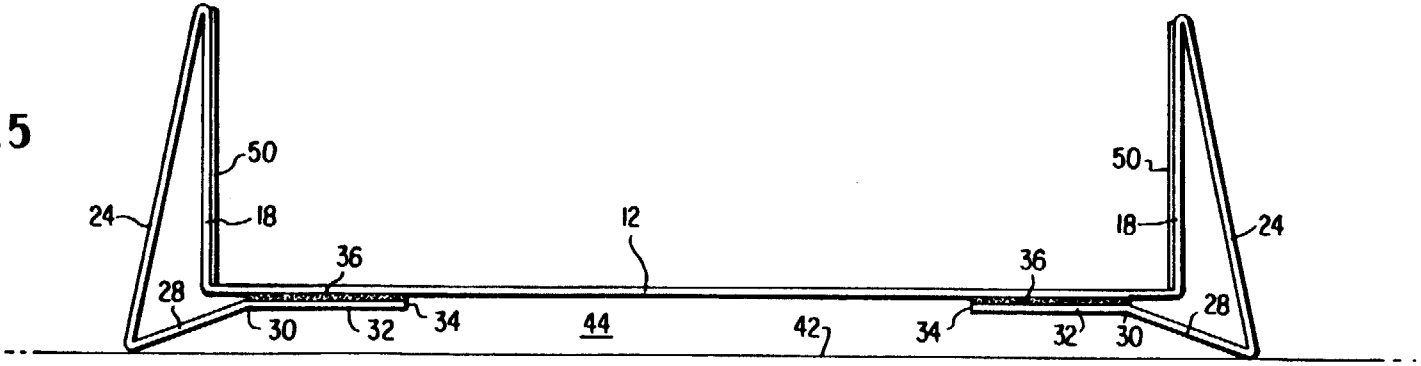

In the variant shown at FIG. 5, the thermal heating layer 50 is located only on the facing, interior surfaces of side wall panels 18.

Figure 6:
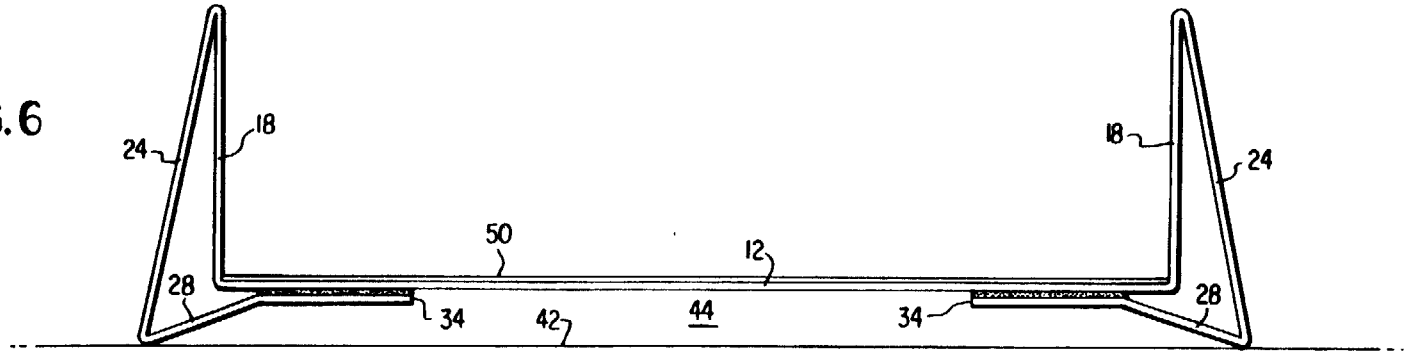

As shown in FIG. 6, only the upper surface of bottom panel 12 carries the thermal heating layer 50.

Figure 7:
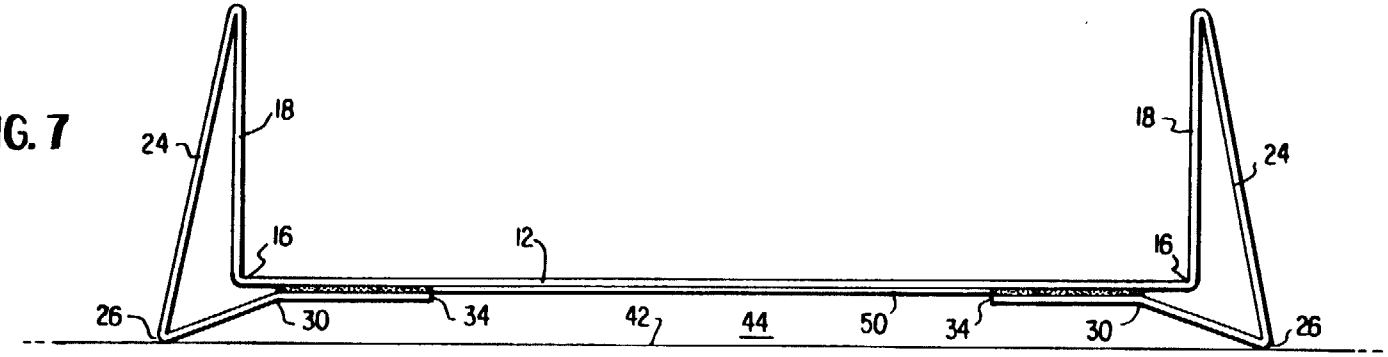

In the pattern modification of FIG. 7, only the lower surface of bottom panel 12 carries the thermal heating layer 50, the layer extending between the free edges 34.

Figure 8:
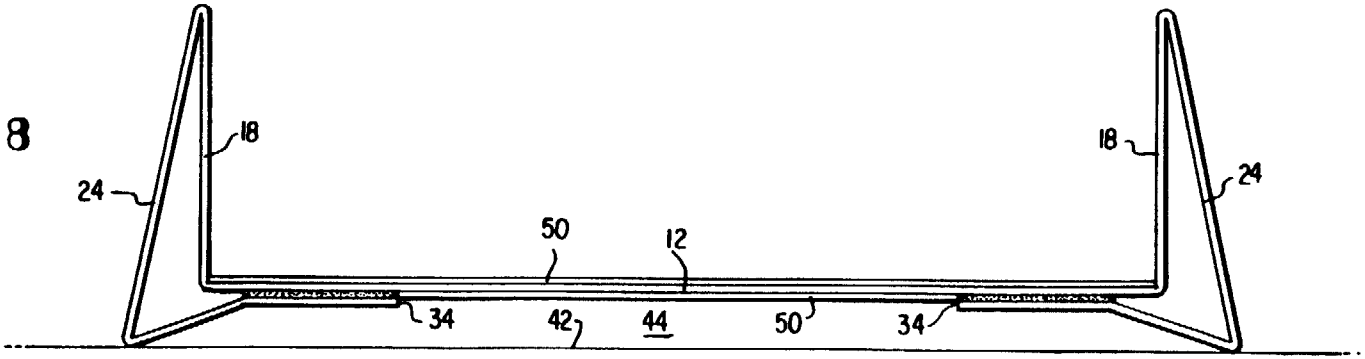

The variant of FIG. 8 illustrates the thermal heating layer as a combination of the patterns of FIGS. 6 and 7, the layer being positioned on both the entire upper surface of bottom panel 12 and on the latter's lower surface, between free edges 34.

In each of FIGS. 3 to 8, the bottom supporting surface 42 of a microwave oven forms, with bottom panel 12 and panel portions 28, an air space 44.

The patterns illustrated in FIG. 3-8 permit variations in the total amount of thermal energy generated by the thermal heating layer 50 and transmitted to the food product, and these patterns also permit a variety of distributions of such thermal energy. For example, if a food product is desired to be browned or crispened only on its bottom potions, then the thermal heating layer 50 patterns shown at any of FIGS. 6, 7 or 8 could be used, with the pattern of FIG. 8 yielding the greatest heat. If only minimal browning heat is required for the bottom browning of the food product, then the pattern of FIG. 7 would be employed. If the sides only of a food product are to be browned, then the pattern of FIG. 5 may be employed. If both the bottom and sides of the food product are to be browned, then the pattern of either FIG. 3 or FIG. 4 may be employed, with the latter being employed if a greater total amount of thermal energy is desired to be delivered to the food product. From a consideration of FIG. 7, it is seen that the foodstuff to be cooked and browned/crisped need not be uniformly in direct contact with the thermal heating layer 50.

In each of the embodiments described thus far, the central, food supporting panel 12 of the container of this invention is supported so that it is above the bottom shelf or turntable of a microwave oven, such elevation being derived from the two longitudinally running legs along the sides of bottom panel 12, to define the open ended air space 44. This places the food item to be cooked slightly above the level of the bottom shelf or turntable of the microwave oven and, in some instances, this enhances the cooking of the food. It will be understood that the elevation of a food product for cooking in a microwave oven is already known, as may be seen by reference to U.S. Pat. Nos. 2,600,566, issued to Moffett and 2,714,070 issued to Welch, the former also disclosing an air space beneath the food product.

Figure 9:
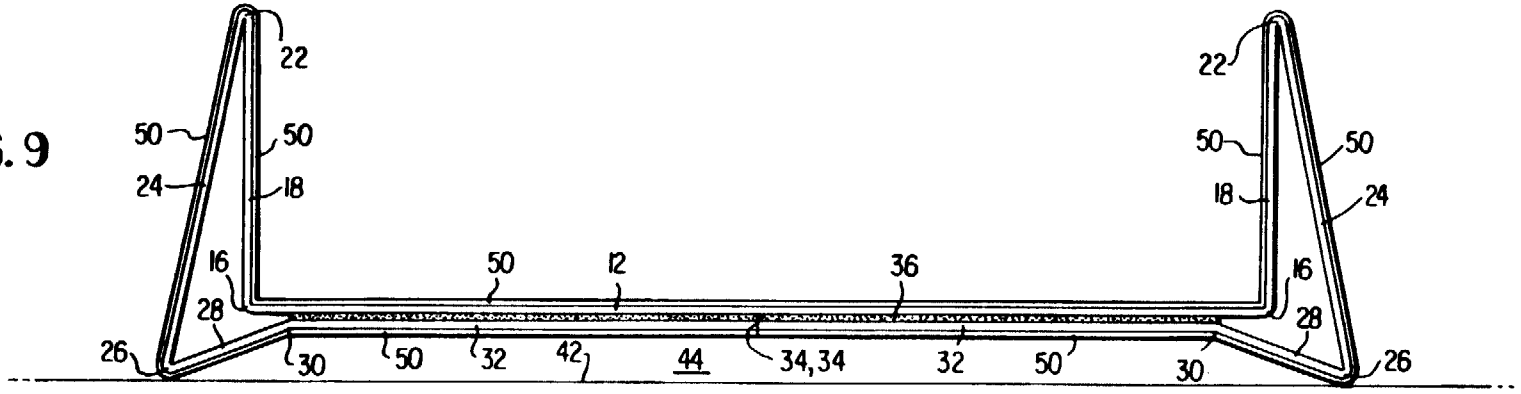
FIG. 9 is a cross sectional view showing a modification of the container of FIG. 1.

FIG. 9 illustrates yet another variant, wherein lower, horizontal panel portions 32 extend toward the center of bottom panel 12 to such an extent that the free edges 34 of the former meet. Further, the thermal heating layer 50 covers the bottom surfaces of panel portions 32, so that, as shown, all external surfaces of the trough shaped container are covered with the thermal heating layer 50.

Figure 10:
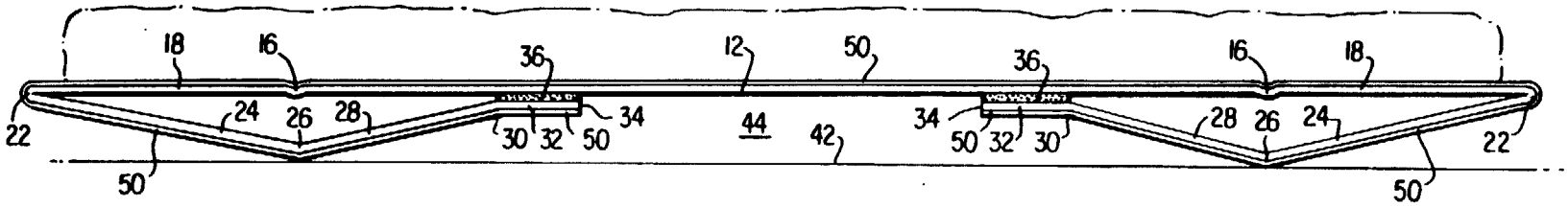
FIG. 10 is a cross sectional view of a modification having the erected form of a flat topped tray.
Figure 11:
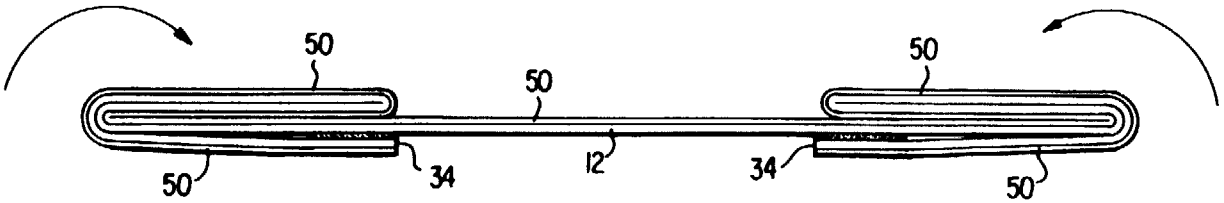
FIG. 11 is a cross sectional view of the tray of FIG. 10 in its collapsed configuration.

A further modification is shown at FIGS. 10 and 11, FIG. 10 illustrating the tray in its operative, foodstuff-cooking configuration. The tray includes the same elements as those previously described, and to which the same reference numerals have been assigned, although the relative widths of the various panels are not the same as their counterpart panels in the earlier figures. Obviously, the relative width of panel 28, as compared with panels 18 and 24, is greater in FIG. 10 than in FIGS. 1-9. This increase in the relative width of panel 28 provides improved stability for the erected form of the tray as shown in FIG. 10. The thermal heating layer 50 pattern corresponds to that shown at FIG. 4, namely, if the side panels 18 of FIG. 4 were rotated outwardly, about creases 16, until panels 18 were coplanar with panel 12, the resultant cross section would be similar to that of FIG. 10. This embodiment is particularly suited for the microwave cooking of a relatively thin food product that requires substantial browning or crisping on its lower surface only. FIG. 11 illustrates the tray of FIG. 10 in its collapsed configuration. From FIGS. 10 and 11, it is seen that fold or crease lines 16 are each located on the horizontal side (coplanar with central panel 50) of each triangular leg and are above and are vertically aligned with a respective apex 26 of each triangular leg. A laterally outermost portion of each elongated leg is defined by those leg portions laterally outwardly of respective, aligned fold lines 16 and apices 26, while a laterally innermost portion of each elongated leg is defined by those portions which are innermost with respect to said respective, aligned fold lines 16 and apices 26. Upon folding, form the configuration of FIG. 10 to the configuration of FIG. 11, each laterally outermost elongated leg portion is seen to lie against and above a respective laterally innermost elongated leg portion.

Figure 14:
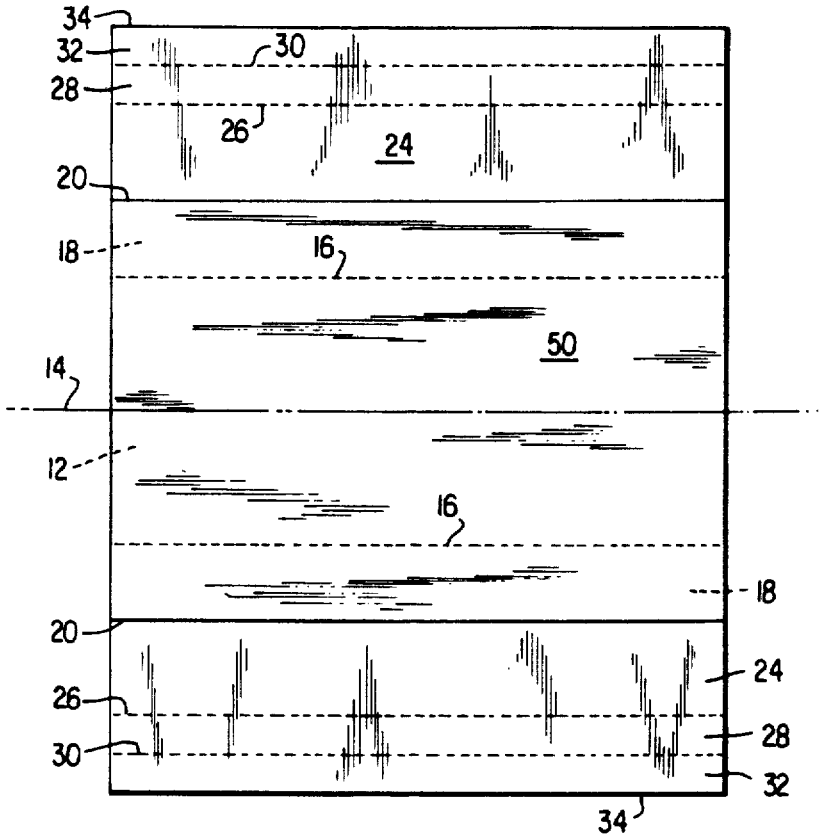
FIG. 14 is a plan view of a blank for forming the container of FIG. 1.

FIG. 14 illustrates a one-piece blank of paperboard, cut and scored to produce the shown fold lines. This blank is used to produce the tray shown at FIGS. 1 and 3. With some modification a blank of the general form of the blank shown at FIG. 14 can be used to produce the containers or trays shown at FIGS. 4 through 10. At FIG. 14 the blank is shown with the thermal heating layer 50 on the top (facing the viewer) surface of the blank. The thermal heating layer 50 covers panel portions 12 and 18 and terminates laterally of axis 14, at crease 20. In forming the blanks for the modifications of FIGS. 4-8, the thermal heating layer 50 would cover different portions of the blank, including the surface away from the viewer for the embodiments shown at FIGS. 7 and 8. Obviously, the width of panel 32 must be increased to provide the blank for the tray shown at FIG. 9; and the widths of panels 18, 24 and 28 must be reportioned to provide the blank for the tray shown at FIG. 10. Further, for the trays shown at FIGS. 9 and 10, the thermal heating layer 50 would cover all surfaces of the blank facing the viewer.

In all of the embodiments presented thus far, panel 18 has been shown as either a vertical or horizontal panel. In many cases it will in fact be preferable to have panel 18 function as a substantially vertical or horizontal panel, but this is not a requirement. It is well within the scope of this invention to have panel 18 purposely inclined, to accommodate the shape of the foodstuff or for other reasons determined by specific uses of the container. In any case, the exact position of panel 18 will be determined by the manner in which the container adjusts to accommodate variations in the size of the foodstuff, as has been discussed.

Some general criteria can be set down governing the design of containers based on the present invention. These criteria are concerned with the relative widths of the various panel portions and specifically the relationships between those widths and the ability of the container to function in the intended manner. In this discussion, the width of a panel is the dimension of the edge of the panel as seen in FIGS. 3-11. The width of a panel will be represented with the letter "w" with a subscript corresponding to the number of the panel. Thus $w_{24}$ is the width of panel 24. The first of the design criteria is that the width of panel 24 must be greater than the width of panel 18 in order for the erected form of any of the containers of this invention to provide the desired elevation of the foodstuff above the bottom shelf or turntable of a microwave oven. This relationship between the widths of panels 24 and 18 can be presented as follows:

$$w_{24} > W_{18} \quad (1)$$

The second design criterion is concerned with the ability of the container to fold flat, as shown at FIGS. 2 and 11. This second principle involves the width of a portion of panel 12 defined on one side by crease 16 and on the other side by an imaginary line directly above and parallel to crease 30. The width of this portion of panel 12 will be represented as $w_{52}$. The relationship that determines the fold flat characteristic of the containers of this invention is as follows:

$$w_{18} - w_{52} = \text{(approximately) } w_{24} - w_{28} \quad (2)$$

This is an approximate relationship because it does not take account of effect of the thickness of the paperboard. The adjustments required to compensate for the paperboard thickness will be easily made by those skilled in the art of designing paperboard containers.

A third criterion concerning the design of the containers of this invention concerns the inclination of panel 28 when the container is in the erected configuration. As shown at FIGS. 1 and 3-10, panel 28 should have a definite downward inclination in the direction away from the central portion of the container. Referring to FIG. 3 for purposes of illustration, it is essential that the downward force provided by the weight of the food cause a clockwise rotational force against panel 28 on the left and a counter clockwise rotational force against panel 28 on the right, the direction in both cases being around the respective crease 30. Rotational forces in the directions just stated are required to keep the container in the erected configuration. Also, these rotational forces against each panel 28 are translated to forces against each panel 18 to assure contact of the foodstuff on each side of the container with the respective panel 18. To provide the essential rotational forces, each panel 28 must be inclined in the general manner shown at FIG. 3. The exact angle of inclination is not critical provided that inclination is downward in the direction away from the central portion of the container. This requirement will generally be satisfied by the trays of this invention unless panel 18 has a substantial bottom-to-top inclination away from the central portion of the tray. In the extreme case where panel 18 is horizontal, as in FIG. 10, the inclination of each panel 28 will be in the required direction for tray stability if the following relationship governs the relative widths of panels 18, 24 and 28 and the panel portion discussed above with width represented as $w_{52}$:

$$(w_{24})^2 < [(w_{18} + w_{52})^2 + (w_{28})^2] \quad (3)$$

The relationship of panel widths established by this relationship insures that panels 28 are inclined downward in the direction away from the central portion of the tray, thus assuring the stability of the erected tray as shown at FIG. 10. This relationship does not apply to the container variants shown at FIGS. 1–9.

Figure 12:
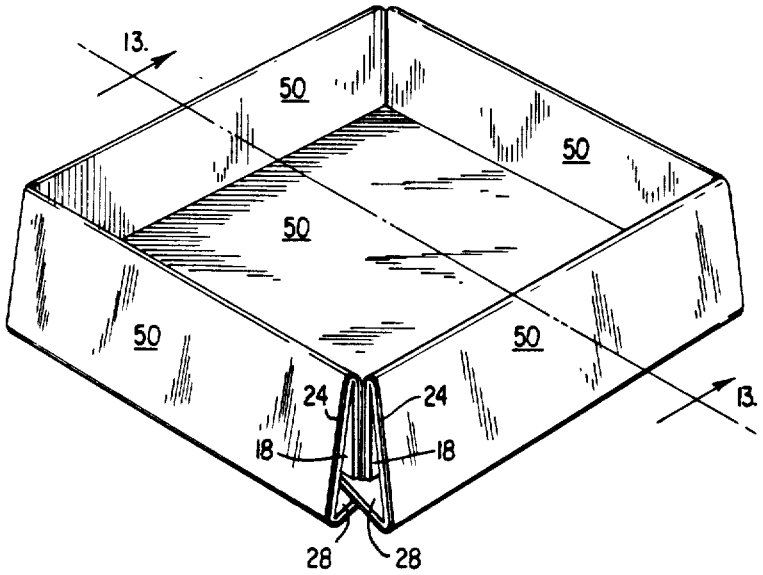
FIG. 12 shows another embodiment of the container of this invention, here in the form of a four-sided tray.
Figure 13:
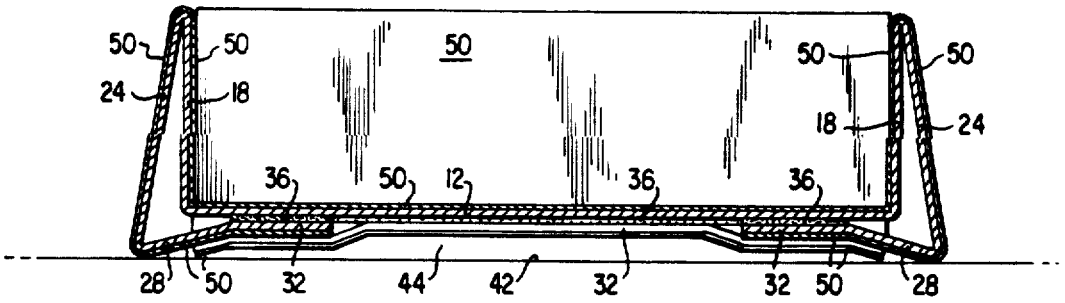
FIG. 13 is a view taken along section 13—13 of FIG. 12.
Figure 15:
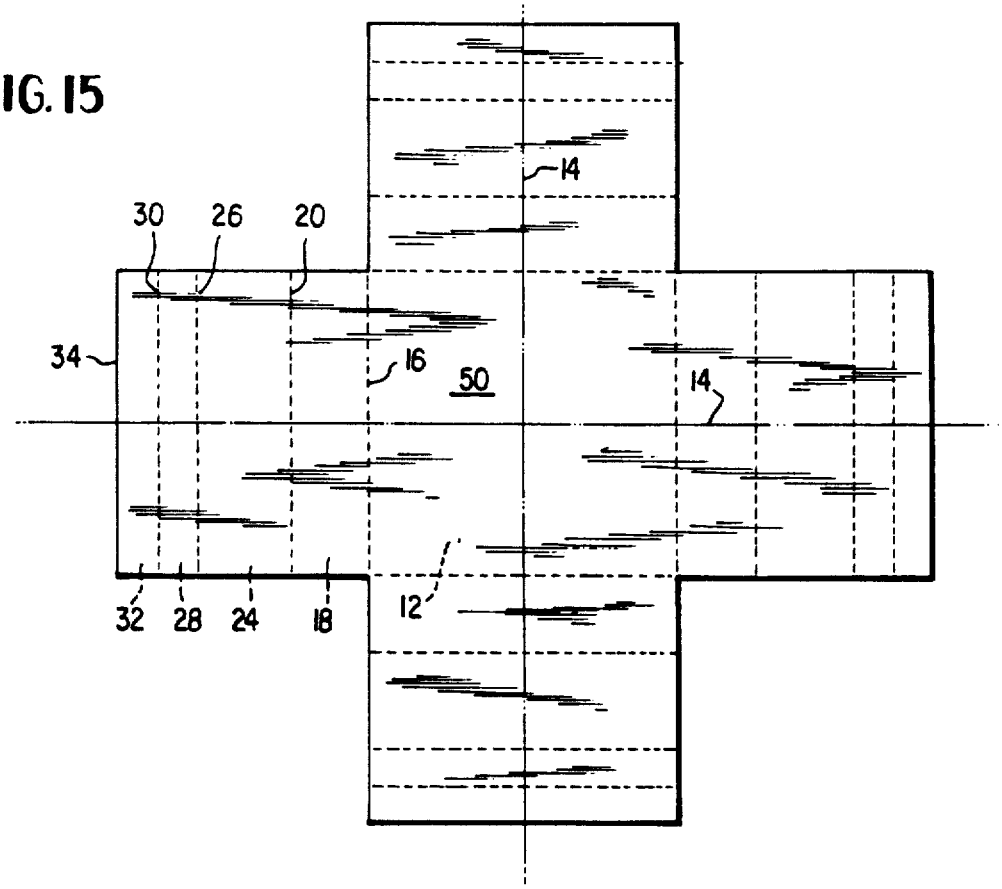
FIG. 15 is a plan view of a blank for forming the container of FIG. 12.

Referring now to FIGS. 12 and 13 of the drawings, another embodiment of the invention is illustrated, this embodiment being similar to the embodiment of FIG. 4 except that the central food supporting panel 12 is provided on each of its four edges with wall elements 18 and 24 corresponding to elements 18 and 24 of FIG. 4. The tray of FIG. 12 is formed of a one-piece blank of paperboard, cut and scored to produce the indicated fold lines as shown at FIG. 15. The blank shown at FIG. 15 has the thermal heating layer on all surfaces facing the viewer, corresponding to the distribution of the thermal heating layer on the container shown at FIG. 12. As in the previously described embodiments, the tray of FIG. 12 is collapsible to a substantially flattened condition, similar to that which is shown at FIG. 2.

Figure 16:
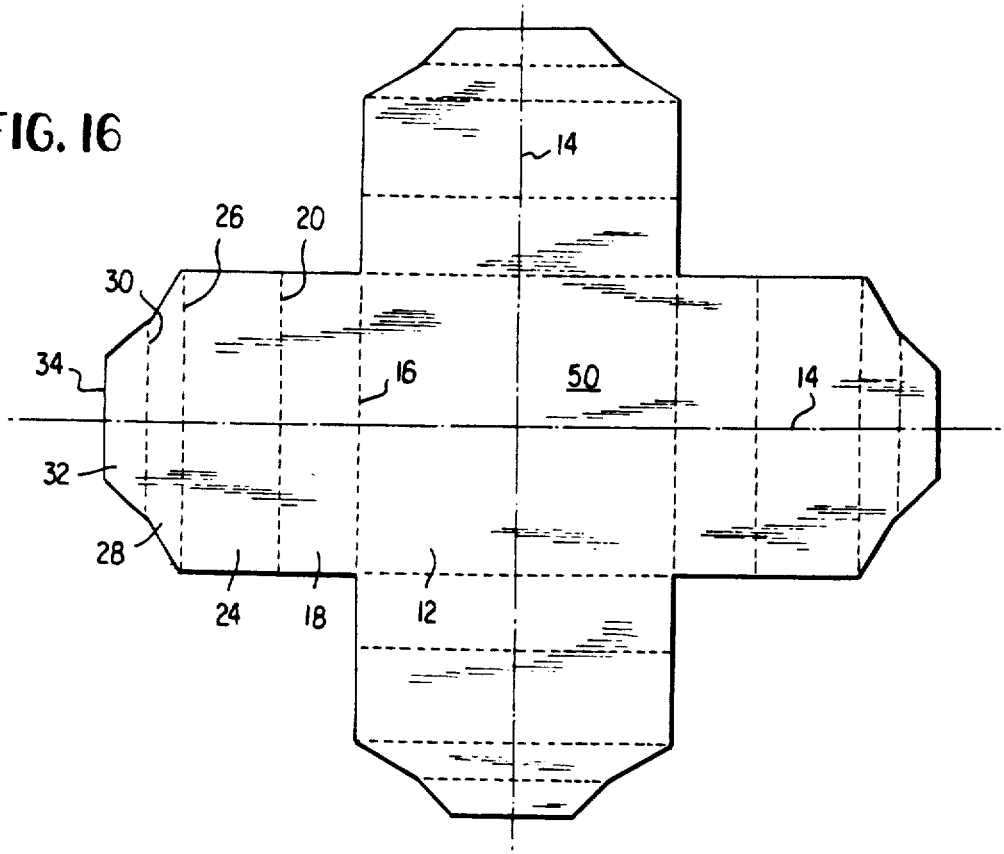
FIG. 16 is a plan view of a modified blank for forming a four-sided tray.
Figure 17:
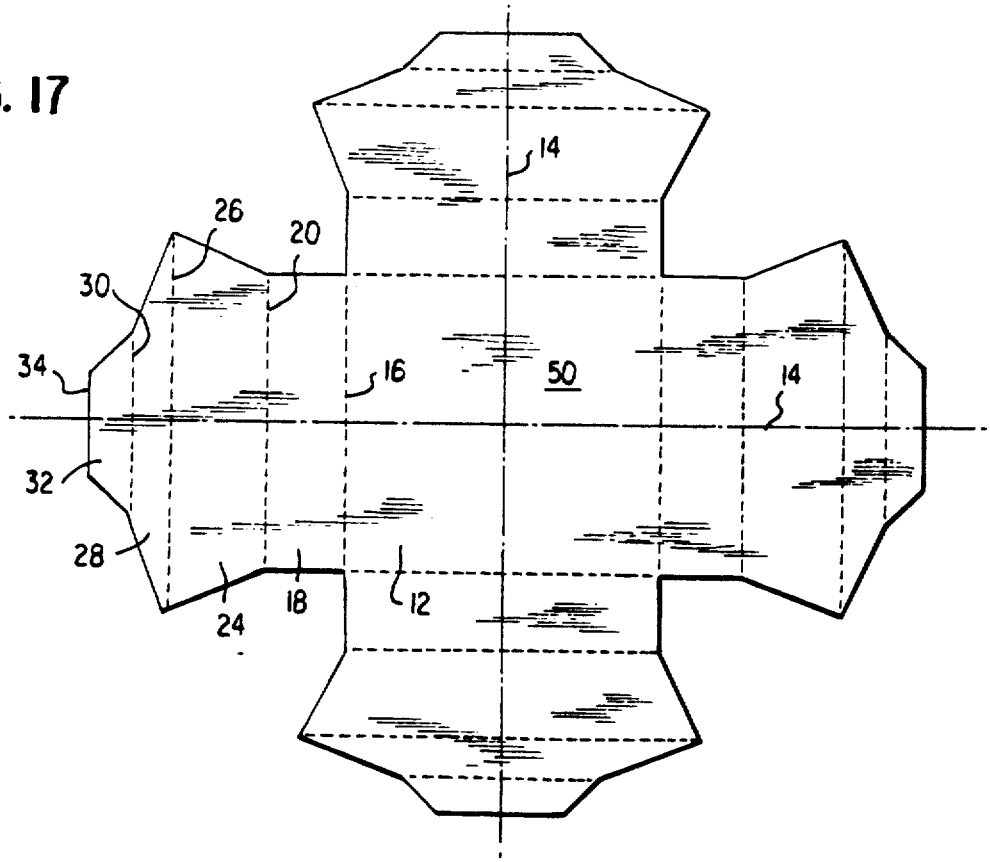
FIG. 17 is a plan view of a further modified blank for forming a four-sided tray.
Figure 18:
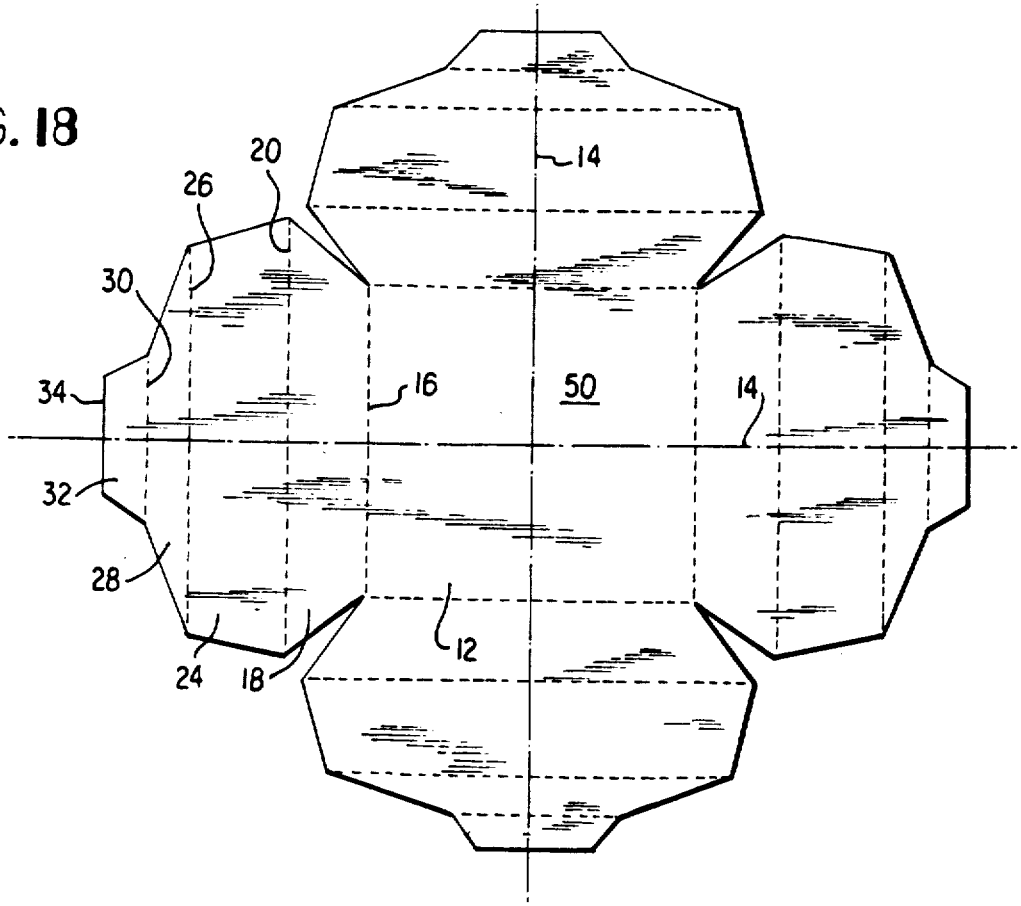
FIG. 18 is a plan view of a modified blank for forming a four-sided tray with closed corners.

It will be noted in the view of the tray shown at FIG. 13 that there is an overlapping condition involving portions of panels 28 and 32 at each of the 4 corners of the tray. This overlapping condition is acceptable, in the case of the tray shown at FIGS. 12 and 13, because of the inherent flexibility of the paperboard. The degree of deformation of the paperboard in the overlapping areas is greatly exaggerated in FIG. 13 because the thicknesses of the paperboard, the adhesive and the thermal heating layer are all shown out of proportion with the other dimensions of the tray. In any case where this overlapping condition is unacceptable, it can be eliminated by using a blank of the general design shown at FIG. 16. Other variations in the design of blanks for 4-sided trays are also within the province of the present invention, including the general design shown at FIG. 17. The blank design shown at FIG. 17 is a general design that can be adapted to close in the open corners of the subject 4-sided tray. For example, if panel 18 has a bottom-to-top inclination away from the central portion of the tray, then a blank of the general design shown at FIG. 18 can be used to provide the tray with closed corners.

Figure 19:
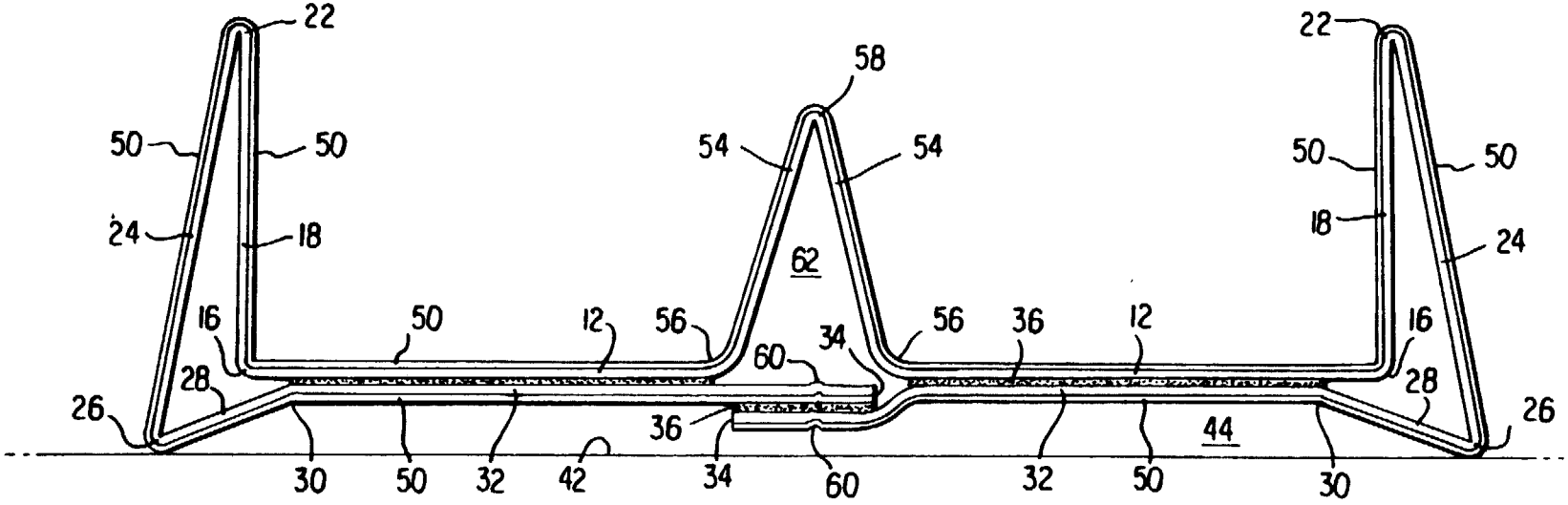
FIG. 19 shows an embodiment of the tray of this invention with a central divider.

In all of the examples presented thus far the subject trays have a single flat, horizontal, rectangular food supporting bottom panel. Further, in all of the examples presented thus far the trays have either two or four food contacting side panels which have either a substantially vertical of substantially horizontal orientation. It is within the scope of this invention to make trays with either food supporting panels or food contacting wall panels that are not subject to the just-stated limitations. For example, a tray with a central divider 62 is shown at FIG. 19. This tray has the food supporting bottom panel divided into two portions on the right and left sides of the divider 62 as shown at FIG. 19. This tray also has additional food contacting wall panels 54, which do not have the vertical orientation of food contacting side panels 18 of the earlier embodiments. This tray can be folded flat in 2 steps. The first folding step is the same as for the trays shown in FIGS. 1 through 9. The second folding step consists of folding the two symmetrical halves of the tray downwards, with axes of folding occurring simultaneously at creases 58 and 60. The tray shown at FIG. 19 has the thermal heating layer covering the full area of all panels of the tray. Divided trays with less complete coverage of the panel areas by the thermal heating layer are within the scope of this invention.

It is not necessary that the trays of this invention have an axis of symmetry. For example a divided tray may have the divider off-center so that the food supporting bottom panel on the right side of the divider may be wider of narrower than the food supporting bottom panel on the left side of the divider.

Figure 20:
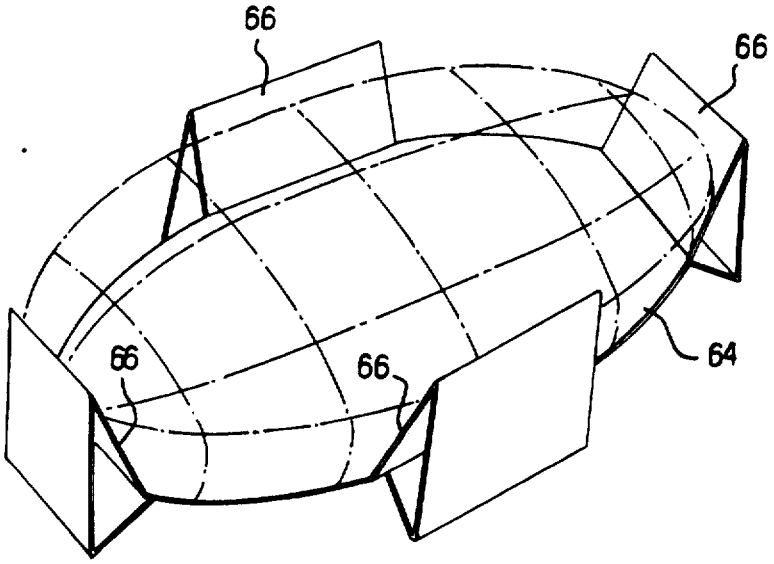
FIG. 20 shows an embodiment of the container of this invention, here in the form of an oval tray.

A tray with a nonrectangular food supporting bottom panel is shown at FIG. 20. This tray has a substantially oval food supporting bottom panel 64 and four food contacting side panels 66. A foodstuff is represented by the broken line form in FIG. 20. Typically, a tray of this design will be used to warm bakery products such as cakes and bread.

Figure 21:
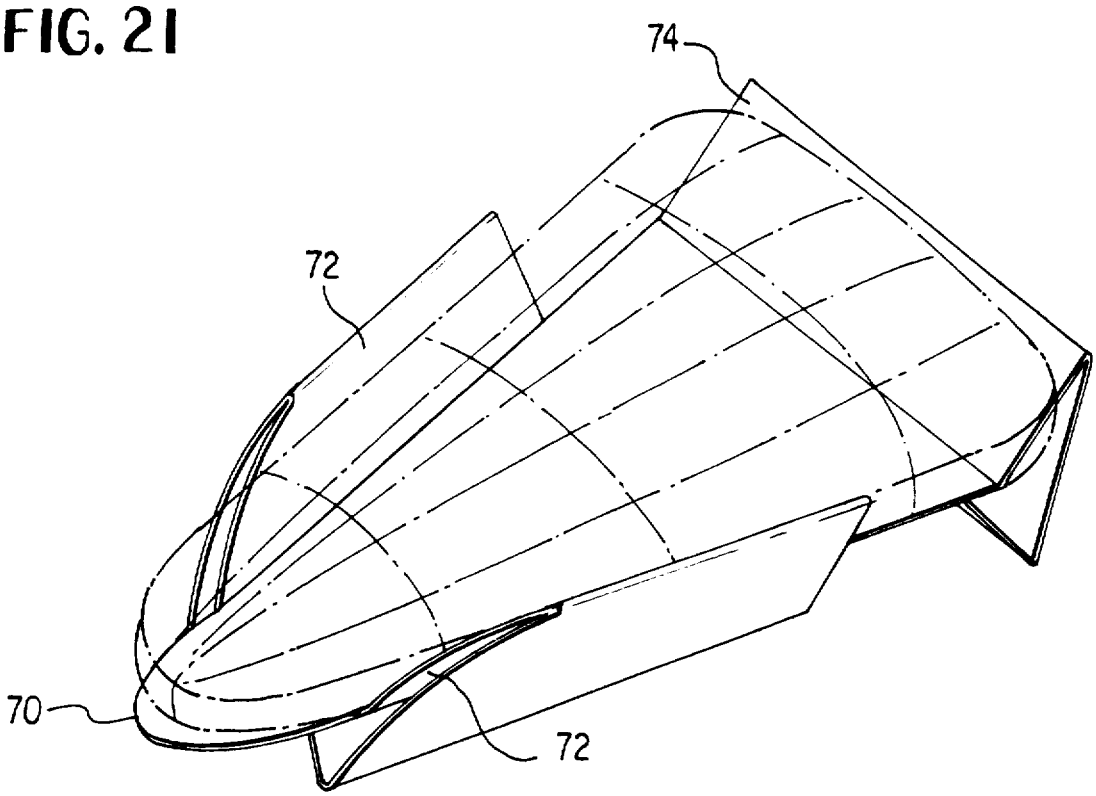
FIG. 21 an embodiment of the container of this invention, here in the form of a triangular tray.

A tray with a nonrectangular food supporting bottom panel and nonrectangular food contacting side panels is shown at FIG. 21. This tray has a substantially triangular food supporting bottom panel 70 with a rounded point, two nonrectangular food contacting side panels 72 and a single rectangular food contacting side panel 74. The broken line form in FIG. 21 represents a foodstuff such as a piece of pie or a portion of quiche.

To simplify the drawings, FIGS. 20 and 21 do not show the extent of coverage of the various panel areas by the thermal heating layer. It is to be understood that the coverage of the panel areas of these trays by the thermal heating layer may be as extensive or as limited as shown for any of the earlier examples. Also, there may be selective coverage of some, but not all of the food contacting side panel areas by the thermal heating layer. For example, in the case of the tray shown at FIG. 21, food supporting bottom panel 70 and food contacting side panel 74 could be covered by the thermal heating layer, while food contacting side panels 72 could be devoid of the thermal heating layer.

The following description provides the details of the complete process of making the container shown at FIGS. 1 through 3. A laminated stock was first produced by laminating a lightly metallized polyester film to a paperboard stock. The lightly metallized polyester film had a thickness of 0.5 mil and was coated with an extremely thin coating of aluminum via the well known process of vacuum metallization, with the level of metallization being only sufficient to provide the film with an optical density in the range of 0.15–0.25. It is known from the prior art that such lightly-metallized polyester films have the characteristic of converting microwave energy to thermal energy when placed in a conventional domestic microwave oven. It is also known that the lamination of such a film on a paperboard substrate provides a material that will function to provide thermal heating effects for food placed in contact therewith in a microwave oven, such effects including the browning and crisping of food surfaces. A typical film of this type has the designation XR48911B and is available commercially from the DuPont Co. The paperboard stock used in this example was a standard grade of paperboard used in food packaging, commonly known as clay-coated SBS, and specifically 14 point VAL U-COAT® supplied by International Paper Company. In the present example, a rectangular blank was cut from the paperboard stock and an adhesive was applied on the side opposite the clay coating covering only that portion of the blank to be covered with the lightly-metallized polyester film, specifically the area that is covered by the thermal heating layer 50 on the blank shown at FIG. 14. The adhesive was a water-based vinyl acetate adhesive, Airflex TM 421 from Air Products and Chemicals, Inc. This adhesive was applied with a standard #4 wire-wound draw down rod, applying a nominal adhesive coating of 0.4 mils thickness before drying. The adhesive coating was air dried and then a piece of the lightly-metallized polyester film, cut to size, was applied over the adhesive coated area, with the metallized surface next to the adhesive. The laminate was then pressed in a laboratory-scale platen press for about 30 seconds at 200–250° F. and 150–200 pounds per square inch. Next, the blank was creased and folded as shown at FIGS. 1–3 and 14, then a water based vinyl acetate adhesive, WB-3544 from H. B. Fuller Co., was applied on each panel 32 with a brush, covering the full length and width of each panel 32 on the clay-coated side. Each panel 32 was then positioned and pressed against the underside of panel 12 in the locations shown at FIGS. 1–3 using the same lab-scale pressing conditions as used for the lamination of the film to the blank. The container provided by the process just described was tested by cooking a frozen French bread pizza, Stouffer's double cheese variety, in a standard domestic 700 watt microwave oven. The pizza was placed in the container as shown at FIG. 1 and cooked for four minutes with the oven set on full power. The pizza was cooked to a highly desirable consistency, being uniformly crisp and brown on the bottom and sides, and tender on the inside. For comparison, a second French bread pizza of the same brand was cooked in the same microwave oven for the same amount of time, but without the use of the container of this invention. In this second cooking test the crust was soft without crispness, and the inside of the pizza had toughened. Containers of the designs shown at FIGS. 4 through 10, and 12, 19, 20 and 21 can be made by following the same general steps as the preceding example. Obviously, the varying extent of coverage of the surface of these containers by the thermal heating layer 50 must be accommodated by adjusting the dimensions of the piece of lightly-metallized polyester film. Of course the area coated with adhesive will in all cases correspond to the area to be covered by the film. In the case of the trays shown at FIGS. 12, 19, 20 and 21, the steps of cutting, creasing and folding the blank and then adhesively bonding the appropriate panel portions to the underside of the central food supporting panel require obvious modifications of the detailed example provided above, but the general steps remain the same.

It is to be understood that the preceding description of materials and methods for the preparation of the container of this invention is intended only as an example and is not to be taken as a limitation on the scope of the invention. Those skilled in the art of producing microwave food packaging materials will recognize that there are many suitable alternative materials and methods.

We claim:

1. A microwave cooking tray, said cooking tray formed from a blank of flexible, resilient, and foldable dielectric sheet material, the tray having a food supporting bottom panel and at least two side walls each of double thickness, to thereby define inner and outer side wall panels, one portion of each of said double thickness side walls extending above a plane defined by said food supporting bottom panel and another portion of each of said double thickness side walls extending below a plane defined by said food supporting bottom panel, inwardly facing surfaces of said inner side wall panels termed interior side wall surfaces, said bottom panel having an upwardly facing surface and a downwardly facing surface, the upwardly facing surface of said bottom panel termed an interior bottom panel surface and the downwardly facing surface of said bottom panel termed an exterior bottom panel surface, at least one of said bottom and inner side wall panels including a microwave interactive thermal heating layer containing a microwave interactive component having an essential characteristic of converting microwave energy to thermal energy, whereby when a food product is placed in the tray and the tray placed in an operating microwave oven, such microwave interactive thermal heating layer will increase in temperature to such an extent that a food product in surface contact with such microwave interactive thermal heating layer will become browned or crispened, said tray being foldable to a flattened storage and shipping configuration by folding the side walls which are above said food supporting bottom panel toward the bottom panel.

2. The microwave cooking tray of claim 1 wherein each said outer side wall panel is wider than each said inner side wall panel so that a portion of each said outer side wall panel extends below said food supporting bottom panel to thereby define elongated legs, whereby when the tray is placed upright on a flat supporting surface, such as the bottom of a microwave oven, an air space is defined below the bottom panel and between said elongated legs.

3. The microwave cooking tray of claim 2 wherein each of said elongated legs includes a slanting continuation thereof extending slantingly upwardly from the lower most edge of each of said outer side wall panels and toward the central portion of the tray and meeting said exterior bottom panel surface, the meeting of each of said upwardly slanting continuations with said exterior bottom panel surface being spaced from the junction of each said inner side wall panel with said food supporting bottom panel, toward the central portion of the tray, to thereby define hollow side walls and hollow elongated legs along the sides of the tray.

4. The microwave cooking tray of claim 3, wherein said food supporting bottom panel is a flat, horizontal, substantially rectangular or square panel.

5. The microwave cooking tray of claim 4 wherein said at least two side walls includes two side walls adjoining opposite parallel edges of said food supporting bottom panel.

6. The microwave cooking tray of claim 5 wherein said inner and outer side wall panels are substantially rectangular.

7. The microwave cooking tray of claim- 6 wherein the composition of said food supporting bottom panel includes a microwave interactive thermal heating layer.

8. The microwave cooking tray of claim 7 wherein said microwave interactive thermal heating layer covers at least a portion of said interior bottom panel surface.

9. The microwave cooking tray of claim 7 wherein said microwave interactive thermal heating layer covers at least a portion of said exterior bottom panel surface.

10. The microwave cooking tray of claim 6 wherein the composition of each of said inner side wall panels includes a microwave interactive thermal heating layer.

11. The microwave cooking tray of claim 10 wherein said microwave interactive thermal heating layer covers at least a portion of said interior side wall surfaces.

12. The microwave cooking tray of claim 7 wherein the composition of each said inner side wall panels includes a microwave interactive thermal heating layer.

13. The microwave cooking tray of claim 6 wherein said at least two side walls includes two additional side walls adjoining a second pair of opposite parallel edges of said food supporting bottom panel, wherein all of said inner and outer side wall panels are substantially rectangular.

14. The microwave cooking tray of claim 6 wherein said food supporting bottom panel is divided into two portions by a bottom panel divider, said bottom panel divider forming two additional inner wall panels.

15. The microwave cooking tray of claim 3 wherein said slanting continuations of each outer side wall panel terminate in horizontally extending panel portions, said horizontally extending panel portions being adhered to said exterior bottom panel surface.

16. The microwave cooking tray of claim 13 wherein a microwave interactive thermal heating layer is included in the composition of said bottom panel, each said inner side wall panel, each said outer side wall panel, each said upwardly slanting continuation and each said horizontally extending panel portions.

17. The microwave cooking tray of claim 14 wherein said at least two die walls includes two additional side walls adjoining a second pair of opposite parallel edges of said food supporting bottom panel, wherein all of said inner and outer side wall panels are substantially rectangular, wherein a microwave interactive thermal heating layer is included in the composition of each of the panels of said microwave cooking tray.

18. The microwave cooking tray of claim 13 wherein the free ends of said horizontally extending panel portions are spaced apart from each other.

19. The microwave cooking tray of claim 13 wherein the free ends of said horizontally extending panel portions meet or overlap each other.

20. The microwave cooking tray of claim 16 wherein said food supporting bottom panel is divided into two portions by a bottom panel divider, said bottom panel divider forming two additional inner wall panels, wherein a microwave interactive thermal heating layer is included in the composition of each of said two additional inner wall panels.

21. The microwave cooking tray of claim 3 wherein said food supporting bottom panel is divided into two portions by a bottom panel divider, said bottom panel divider forming two additional inner wall panels.

22. The microwave cooking tray of claim 3 wherein said food supporting bottom panel is of a rounded shape.

23. The microwave cooking tray of claim 22 wherein said at least two side walls consists of four side walls adjoining edges of said food supporting bottom panel.

24. The microwave cooking tray of claim 3 wherein said food supporting bottom panel is of a nonrectangular, substantially polygonal shape.

25. The microwave cooking tray of claim 24 wherein said at least 2 side walls consists of 3 sidewalls adjoining edges of said food supporting bottom panel.

26. The microwave cooking tray of claim 3 wherein at least one of said inner side wall panels is nonrectangular.

27. The microwave cooking tray formed of a blank of flexible, resilient and foldable dielectric sheet material, the tray having a central panel, at least two edges of said central panel each carrying there along an elongated leg triangular in transverse cross section, each triangular leg having three apices, one side of each triangular leg being a horizontal side, each said horizontal side being coplanar with said central panel, each triangle apex opposite to said horizontal side being vertically spaced downwardly from said central panel, said opposite to said horizontal side apices forming elongated supports, at least one of said central panel and said triangular legs including a microwave interactive thermal heating layer, a fold line on each said horizontal side of each triangular leg, each said fold lien running parallel to and vertically aligned with a respective one of said apices which is opposite to said horizontal side, each said fold line and its respective vertically aligned one of said apices defining a laterally outermost portion and a laterally innermost portion of a respective said elongated leg whereby the tray can be folded to a more compact configuration by folding said laterally outermost elongated leg portion of each said elongated leg upwardly and then inwardly towards said central panel so as to cause said laterally outermost elongated leg portion to lie against and above a respective laterally innermost elongated leg portion.

28. The microwave cooking tray of claim 27 wherein a microwave interactive thermal heating layer is included in the composition of said central panel and each said triangular leg.

* * * * *

UNITED STATES PATENT AND TRADEMARK OFFICE

CERTIFICATE OF CORRECTION

PATENT NO. : 5,153,402

DATED : October 6, 1992

INVENTOR(S) : James R. Quick et al

It is certified that error appears in the above-identified patent and that said Letters Patent is hereby corrected as shown below:

Add Figure 21 to the drawings.

Signed and Sealed this

Nineteenth Day of October, 1993

*Attest:*

Bruce Lehman

BRUCE LEHMAN

*Attesting Officer*

*Commissioner of Patents and Trademarks*